US006859635B2

(12) United States Patent
Yabuki et al.

(10) Patent No.: US 6,859,635 B2
(45) Date of Patent: Feb. 22, 2005

(54) COLOR IMAGE RECORDING APPARATUS HAVING MOVABLE IMAGE FORMING SECTIONS

(75) Inventors: Makoto Yabuki, Tokyo (JP); Masanori Maekawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 32 days.

(21) Appl. No.: 10/347,586

(22) Filed: Jan. 22, 2003

(65) Prior Publication Data

US 2003/0138275 A1 Jul. 24, 2003

(30) Foreign Application Priority Data

Jan. 23, 2002 (JP) ..... 2002-014092

(51) Int. Cl.[7] ..... G03G 15/01
(52) U.S. Cl. ..... 399/299; 399/303
(58) Field of Search ..... 399/299, 303, 399/126

(56) References Cited

U.S. PATENT DOCUMENTS 5,893,017 A * 4/1999 Yamamoto ..... 399/299
5,937,246 A * 8/1999 Kaneyama ..... 399/299
5,960,241 A * 9/1999 Yoshida ..... 399/299
5,983,042 A * 11/1999 Nagata et al. ..... 399/299
6,385,425 B1 * 5/2002 Tanaka ..... 399/299

* cited by examiner

*Primary Examiner*—Susan Lee
(74) *Attorney, Agent, or Firm*—Rabin & Berdo, P.C.

(57) ABSTRACT

A color image recording apparatus includes a mechanism that switches a plurality of image forming sections between image forming positions where the photoconductive drums are in contact with a transport belt and non-image forming positions where the photoconductive drums are not in contact with the transport belt. A pair of slide links extend and are slidable in a direction in which the image forming sections are aligned. Each of the slide links has first guide surfaces and second guide surfaces. When the image forming sections are at the image forming positions, supporting shafts of corresponding one of image forming sections rest on the first guide surfaces. When the image forming sections at the non-image forming positions, the supporting shafts of corresponding one of image forming sections rest on the second guide surfaces.

13 Claims, 17 Drawing Sheets

COLOR IMAGE RECORDING APPARATUS HAVING MOVABLE IMAGE FORMING SECTIONS

BACKGROUND OF THE INVENTION

1. Field of the Invention

The present invention relates to a color image recording apparatus capable of printing color images and monochrome images.

2. Description of the Related Art

A conventional color image recording apparatus includes a plurality of image forming sections that form images of corresponding colors. Such a conventional apparatus incorporates a transport belt that contains an additive material for stabilizing an electrical resistance of the transport belt. The additives will be deposited on the surface of the transport belt to gradually contaminate the surfaces of the photoconductive drums in contact with the transport belt. In order to prevent the additives from being deposited on the transport belt, the image forming sections incorporate corresponding up-down mechanisms so that each image forming section can be moved away from the transport belt independently of the others when the image forming section is not in operation. Each up-and-down mechanism includes cams and links and is driven by a corresponding drive motor.

When print paper becomes jammed in the middle of a paper feeding operation, the up-and-down mechanism causes the respective image forming sections to move away from the transport belt, thereby facilitating removal of the jammed print paper from the image forming sections.

Providing an up-and-down mechanism in an image recording apparatus increases the overall weight and assembly time of the apparatus, failing to meet the demands for small size, light weight, and low price.

SUMMARY OF THE INVENTION

An object of the invention is to provide a color image recording apparatus in which an up-and-down mechanism is simplified to implement a small-size, lightweight, and low-cost apparatus.

A color image recording apparatus incorporates a plurality of image forming sections that form images. The images are transferred onto a recording medium to form a color image. The apparatus includes a mechanism and a first drive source. The mechanism causes the plurality of image forming sections to switch between corresponding image forming positions and corresponding non-image forming positions. The first drive source generates a drive force for driving the mechanism. The drive source is one of second drive sources that drive the plurality of image forming sections when recording is performed.

When each of the plurality of image forming sections is at a corresponding one of the image forming positions, the each image forming section is in contact with a transport belt that runs with the recording medium placed thereon. When each of the plurality of image forming sections is at a corresponding one of the non-image forming positions, the each of the plurality of image forming sections is not in contact with the transport belt.

The plurality of image forming sections are aligned along a transport direction in which the transport belt runs through the plurality of image forming sections. The first drive source is an electric motor that drives one of the plurality of image forming sections that is located most downstream with respect to the transport direction.

The mechanism includes a pair of slide links that extend and are slidable in first directions substantially perpendicular to directions in which the plurality of image forming sections move between the corresponding image forming positions and the corresponding non-image forming positions. The mechanism includes a pair of slide links and a drive force transmitting section. The pair of slide links extend and are slidable in first directions substantially perpendicular to directions in which the plurality of image forming sections move between the corresponding image forming positions and the corresponding non-image forming positions. The drive force transmitting section transmits the drive force from the first drive source. Each slide link of the pair of slide links has a first guide surface and a second guide surface. When the corresponding one of image forming sections is at the corresponding one of the image forming positions, a supporting shaft of a corresponding one of image forming sections rests on the first guide surface. When the supporting shaft of the corresponding one of image forming sections is at the corresponding one of the non-image forming positions, the supporting shaft of the corresponding one of image forming sections rests on the second guide surface.

The color image recording apparatus may further include a drive force transmitting section that transmits the drive force from the first drive source to the pair of slide links. The drive force transmitting section includes a rotating shaft, racks, gears, and a gear train. The rotating shaft extends in a direction at an angle with the first directions and has a one way gear mounted thereto. The racks are provided on corresponding one ends of the slide links. The gears are mounted to the rotating shaft through the one way gear. When the supporting shaft of each of image forming sections moves from the first guide surface to the second guide surface, each of the gears is in meshing engagement with each of the racks and rotates together with the rotating shaft. The drive force is transmitted to gear train through which the gears.

The color image recording apparatus may further include a drive force transmitting section that transmits the drive force from the first drive source to the pair of slide links. The drive force transmitting section includes a rotating shaft, urging members, a gear, and a gear train. The rotating shaft extends in a direction at an angle with the first directions and has eccentric cams mounted thereto. Each of the eccentric cams has a cam surface. Each of the urging members urges one longitudinal end of a corresponding one of the slide links against the cam surface. When the supporting shaft of the corresponding one of image forming sections moves from the first guide surface to the second guide surface, the gear is mounted to the rotating shaft through a one way clutch that engages to rotate together with the rotating shaft. The drive force is transmitted to the gear through the gear train.

Each slide link of the pair of slide links has a beveled surface through which the first guide surface is connected to the second guide surface.

The color image recording apparatus may further include a slide detector that detects an amount of movement of the pair of slide links in the first directions. The first drive source is controlled in accordance with the amount of movement.

The color image recording apparatus may further include a drive force transmitting section that transmits the drive force from the first drive source to the pair of slide links. The drive force transmitting section includes a rotating shaft, a sun gear, first and second racks, a pinion gear, a gear train, and a planetary gear. The rotating shaft extends in a direction at an angle with the first directions. The sun gear is mounted to the rotating shaft. The first rack and second rack are provided on one end of each slide link of the pair of slide links. The pinion gear is in mesh with the second rack. The drive force is transmitted to the sun gear through the gear train. The planetary gear rotates in mesh with the sun gear. When the image forming sections should be moved to the corresponding image forming positions, the planetary gear moves into meshing engagement with the first rack. When the image forming sections should be moved to the corresponding non-image forming positions, the planetary gear moves around the sun gear into meshing engagement with the pinion gear.

The color image recording apparatus may further include a jam detector. When the jam detector detects a jam of the recording medium, the first drive source drives the image forming sections to move to the corresponding non-image forming positions.

A color image recording apparatus incorporates a plurality of image forming sections form images and the images are transferred onto a recording medium to form a color image. The apparatus includes a mechanism and a drive source. The mechanism causes the plurality of image forming sections to switch between corresponding image forming positions and corresponding non-image forming positions, the image forming sections being switched at different ways from one another. The drive source drives the mechanism to operate.

The plurality of image forming sections include color image forming sections and a monochrome image forming section. When the plurality of image forming sections should be moved to the corresponding image forming positions, the mechanism causes the monochrome image forming section to move to a corresponding image forming position and subsequently the color image forming sections to move to corresponding image forming positions. When the plurality of image forming sections should be moved to the corresponding non-image forming positions, the mechanism causes the color image forming sections to move to corresponding non-image forming positions and subsequently the monochrome image forming section to move to a corresponding non-image forming position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

{Construction}

Figure 1:
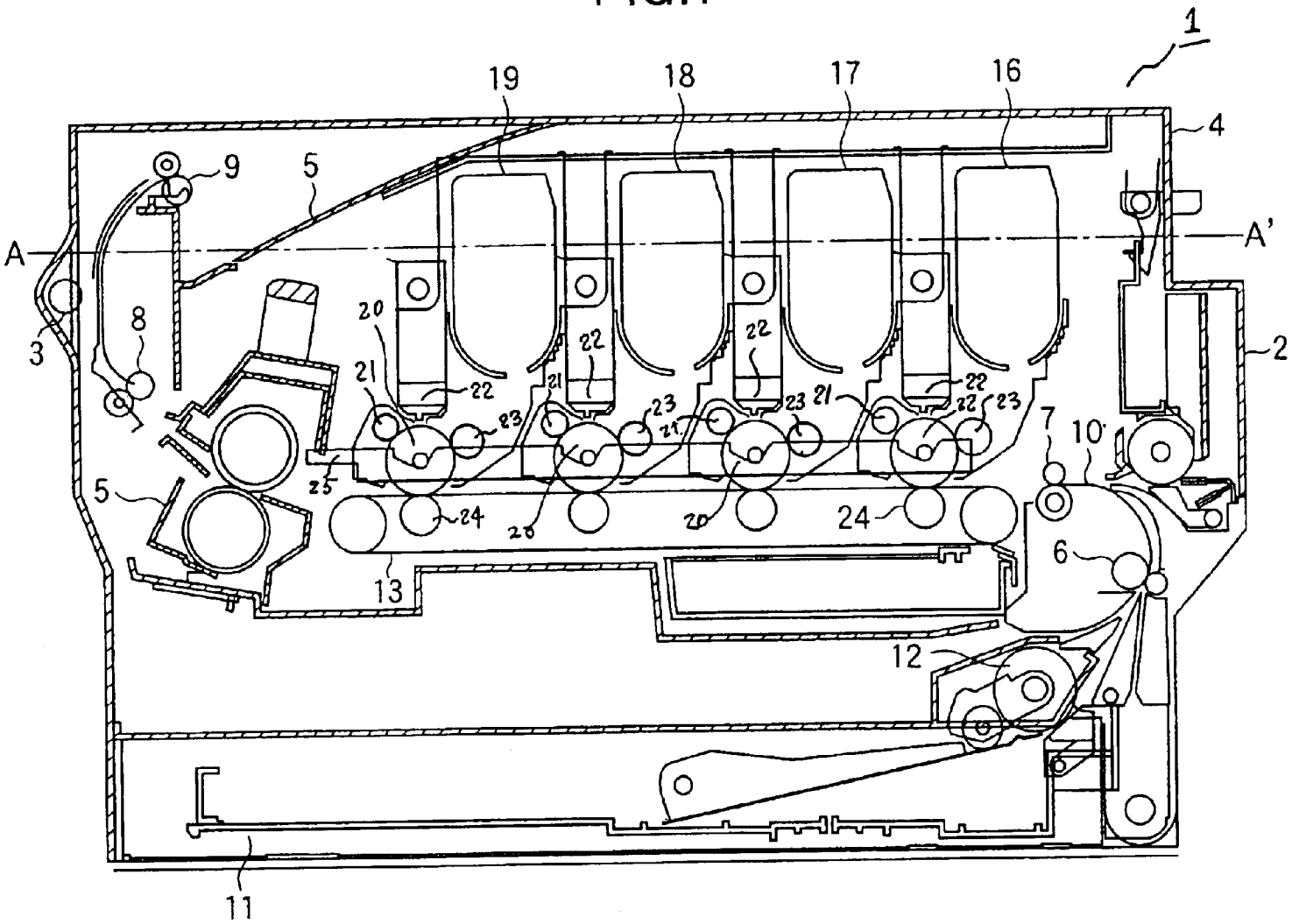
FIG. 1 is an illustrative diagram, showing a general configuration of a color image recording apparatus according to a first embodiment.

FIG. 1 is an illustrative diagram, showing a general configuration of a color image recording apparatus according to a first embodiment.

A color image recording apparatus 1 has an upper cover 4 and a lower cover 2. The upper cover 4 is pivotal about a shaft 3 with respect to the lower cover 2, so that the upper cover 4 closes and opens at a plane depicted by a line A—A of the lower cover 2. The upper cover 4 has a stacker 5 formed therein.

The lower cover 2 has a medium path 10 along which feed rollers 6–9 are disposed. A paper cassette 11 is disposed at the entrance of the medium path 10 and the stacker 5 is disposed at the exit of the medium path 10.

Image forming sections 16–19 for black, yellow, magenta, and cyan are of the same configuration and are disposed along a medium transport belt 13.

Each of the image forming sections 16–19 incorporates a photoconductive drum 20 around which a charging roller 21, recording head 22, developing roller 23, and transfer roller 24 are disposed. The charging roller 21 charges the surface of the photoconductive drum 20 and the recording head 22 forms an electrostatic latent image on the charged surface of the photoconductive drum 20. The developing roller 23 deposits toner on the electrostatic latent image to develop the electrostatic latent image into a toner image. The transfer roller 24 is charged to a polarity opposite to that of the toner and transfers the toner image onto print paper on the transport belt 13.

In a color printing mode, the image forming sections 16–19 transfer images of the respective colors one over the other onto the print paper, thereby forming a full color image.

In a monochrome printing mode, the image forming sections 17–19 for yellow, magenta, and cyan form no electrostatic latent images on their photoconductive drums 20. Only the image forming section 16 for black forms an electrostatic latent image on its photoconductive drum 20 and transfers the toner image onto the print paper.

When printing is not to be performed, the up-down mechanism causes the slide links 25 to move in the B direction, so that the image forming sections 16–19 are away from the transport belt 13. This prevents oligomer or the like deposited on the surface of the transport belt 13 from contaminating the photoconductive drums 20 of the image forming sections 16–19.

Figure 2:
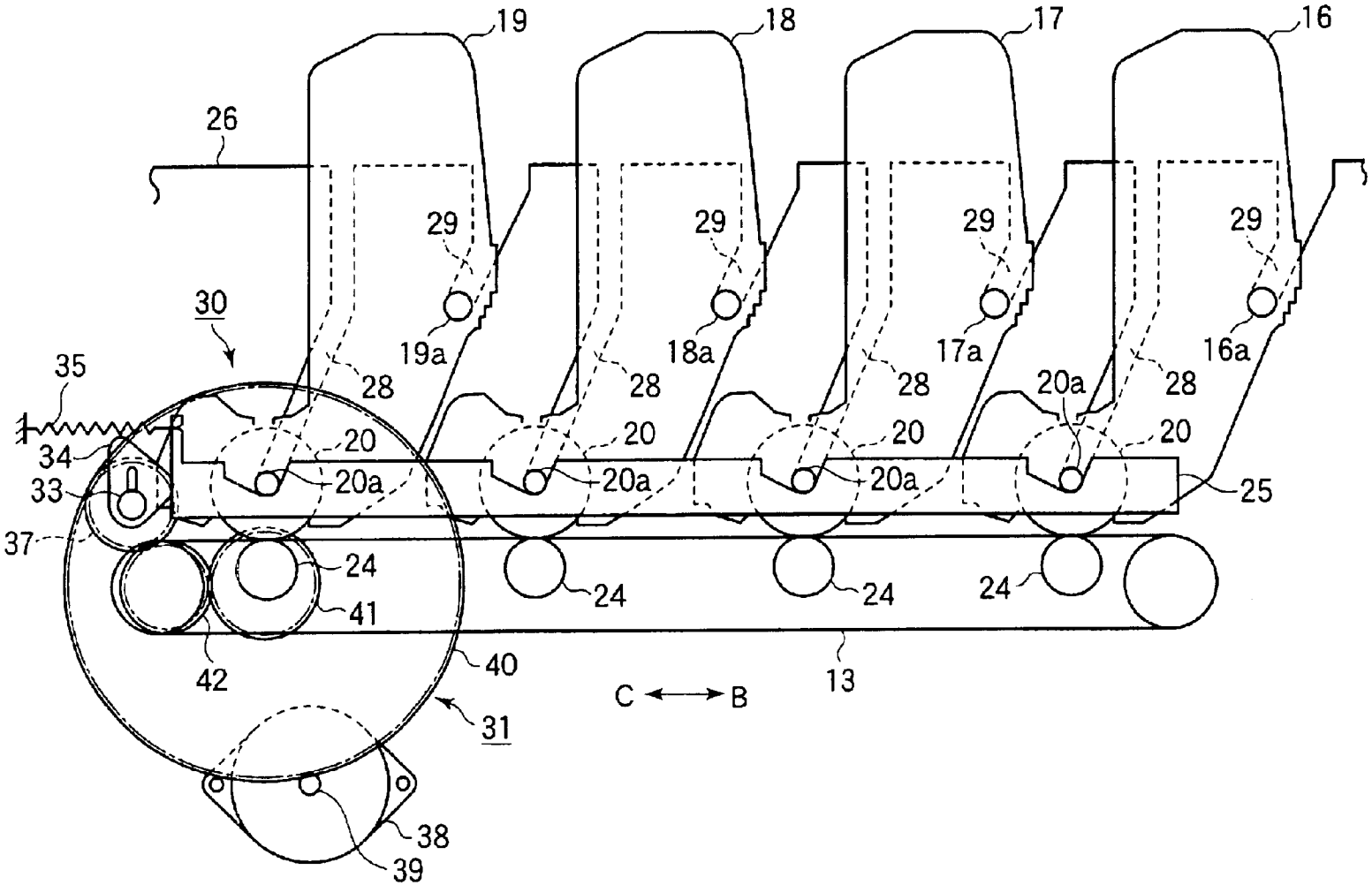
FIG. 2 illustrates the pertinent portion of the first embodiment.

FIG. 2 illustrates the pertinent portion of the first embodiment.

Figure 3:
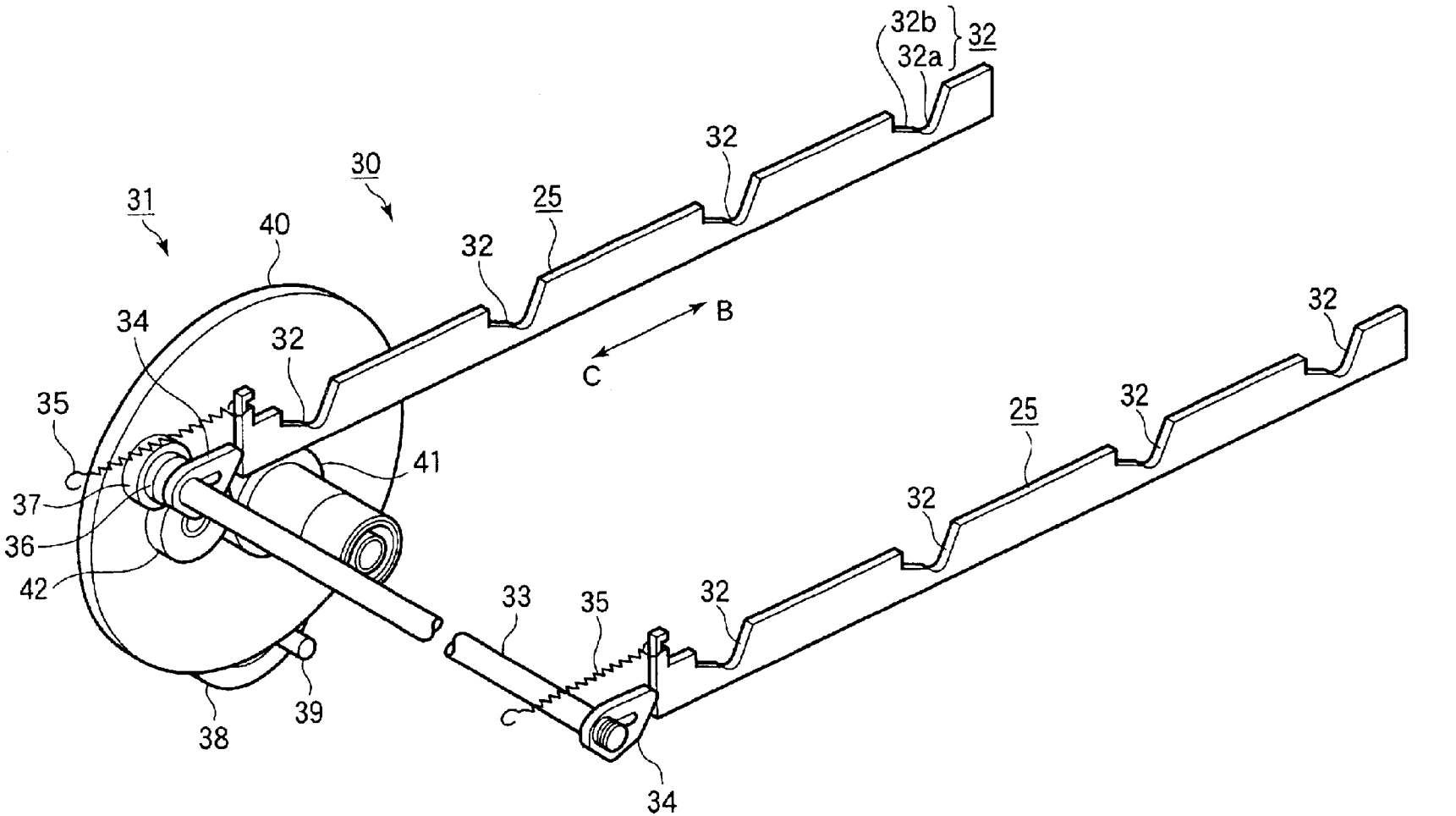
FIG. 3 is a perspective view of an up-and-down mechanism shown in FIG. 2.

FIG. 3 is a perspective view of an up-and-down mechanism shown in FIG. 2.

The image forming sections 16–19 are disposed between frames 26 and 27. The frames 26 and 27 are formed with guide grooves 28 and 29 therein by which the image forming sections 16–19 are guided when they are brought to their up positions and down positions. The guide grooves 28 receive shafts 20*a* of the photoconductive drums 20. The guide grooves 29 receive shafts 16*a*, 17*a*, 18*a*, and 19*a* that project from the image forming sections 16–19. The guide grooves 28 extend parallel to the guide grooves 29.

The up-and-down mechanism 30 includes a pair of slide links 25 and 25 and a drive force transmitting section 31 that causes the slide links 25 and 25 to perform reciprocating motions in directions shown by arrows B and C. The slide links 25 and 25 have guide surfaces 32 on which the shafts 20*a* of the photoconductive drums 20 of the image forming sections 16–19 ride. The guide surface 32 includes a first guide surface 32*a* and a second guide surface 32*b*. The slide links 25 and 25 slide in the B and C directions substantially perpendicular to the up-and-down directions in which the image forming sections 16–19 move to the up positions and down positions. The first guide surfaces 32*a* support the shafts 20*a* such that the image forming sections 16–19 are at their down positions. The second guide surfaces 32*b* support the shafts 20*a* such that the image forming sections 16–19 are at their up positions.

The drive force transmitting section 31 includes a shaft 33, eccentric cams 34 and 34, springs 35 and 35, one way clutch 36, gear 37, and gears 40–42. The shaft 33 extends in a direction substantially perpendicular to the slide links 25 and 25. The eccentric cams 34 and 34 are fixedly attached to the shaft 33. The springs 35 and 35 urge the slide links 25 and 25 in the C direction against the eccentric cams 34 and 34. The one way clutch 36 engages the shaft 33 when the image forming sections 16–19 are to move from their down positions to their up positions. The gear 37 is assembled to the shaft 33 via the one way clutch 36. The gears 40–42 transmit a drive force from a drive gear 39 of a drive motor 38 to the gear 37.

The up-and-down mechanism 30 is driven by one of the drive motors that drive the image forming sections 17–19 during printing. In the first embodiment, the up-and-down mechanism 30 is driven by the drive motor 38 for the image forming section 19 (cyan), most remote from the image forming section 16 (black).

{Operation}

Figure 4:
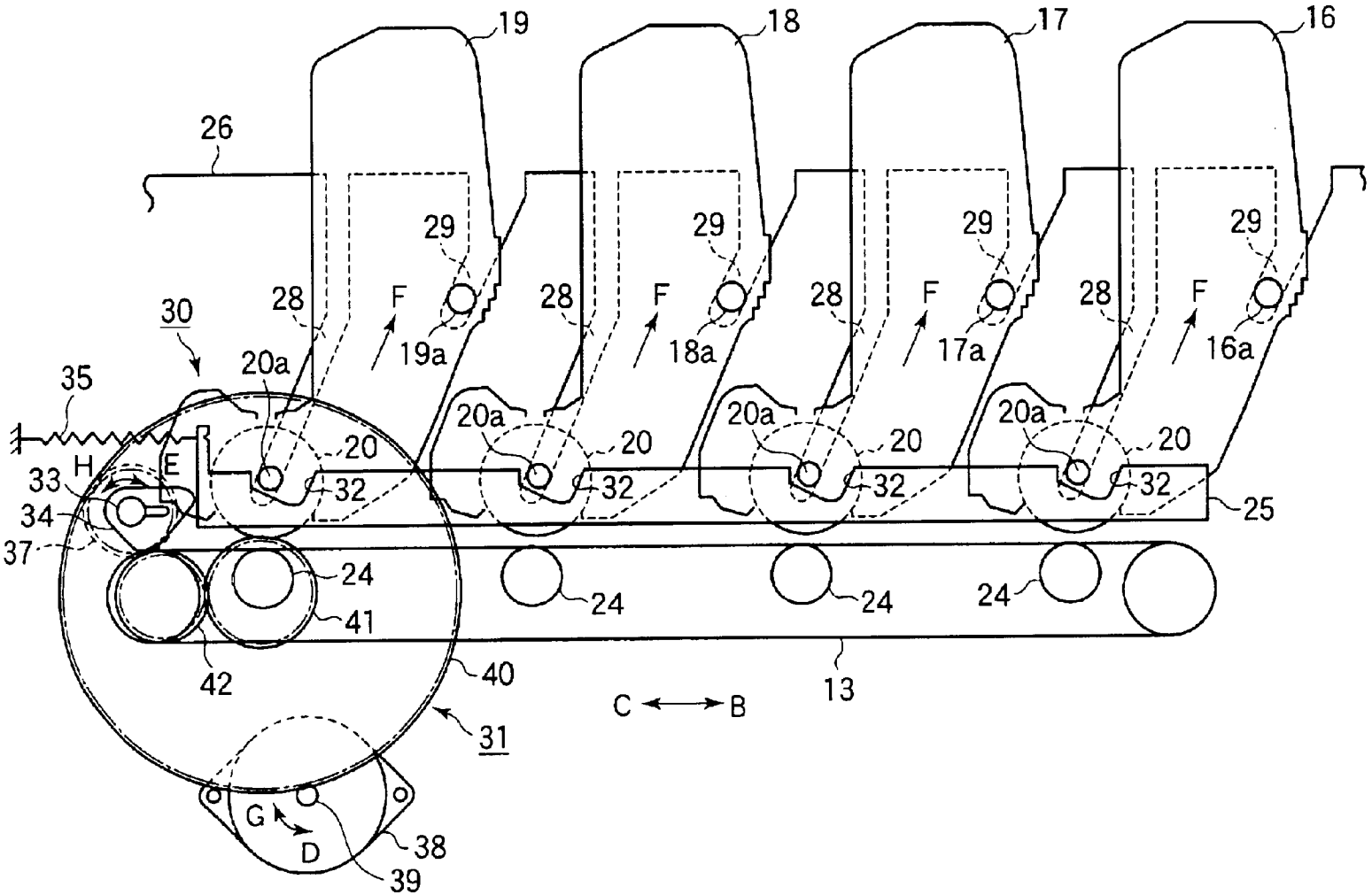
FIG. 4 illustrates the image forming sections when they are at their up positions.

FIG. 4 illustrates the image forming sections when they have are at their up positions.

The operation of the up-and-down mechanism 30 will be described with reference to FIG. 4.

When printing is not to be performed, the rotation of the drive motor 38 in a direction shown by arrow D is transmitted through the gears 40–42 to the gear 37, so that the gear 37 rotates in a direction shown by arrow E.

The rotation of the gear 37 in the E direction causes the one way clutch 36 to engage causing the shaft 33 to rotate in the E direction. The eccentric cam 34 also rotates to cause the slide links 25 and 25 to move in the B direction against the urging force of the springs 35 and 35.

The movement of the slide links 25 and 25 in the B direction causes the shafts 20*a* of the image forming sections 16–19 to move along the guide surface 32, with the shafts 20*a* being guided in the guide grooves 26 in a direction shown by arrow F. The shafts 16*a*, 17*a*, 18*a*, and 19*a*, which project from the side walls of the image forming sections 16–19, also move in the guides 29 in the F direction.

When the image forming sections 16–19 have moved a predetermined distance away from the transport belt 13, the motor 38 is stopped and then a holding current is supplied to the motor 38 to maintain the shafts 20*a* at a specific rotational position where they come to rest.

During printing, the drive motor 38 rotates in a direction shown by arrow G, causing the gear 37 to rotate in a direction shown by arrow H. The rotation of the gears 37 in the H direction causes the one way clutch 30 to disengage so that the clutch races. The urging forces exerted by the urging members 35 and 35 cause the slide links 25 and 25 to move in the C direction, and the weights of the image forming sections 16–19 causes the shafts 20*a* to slide down on the guide surfaces 32. As a result, the shafts 20*a* move to their down positions and the photoconductive drums 20 of the image forming sections 16–19 move into pressure contact with the transport belt 13.

The rotation of the drive motor 38 in the G direction is transmitted via a gear train, not shown, to the photoconductive drums 20, the shafts 20*a*, charging roller 21, developing roller 23, transfer roller 24, thereby performing an image forming operation.

Second Embodiment

Figure 5:
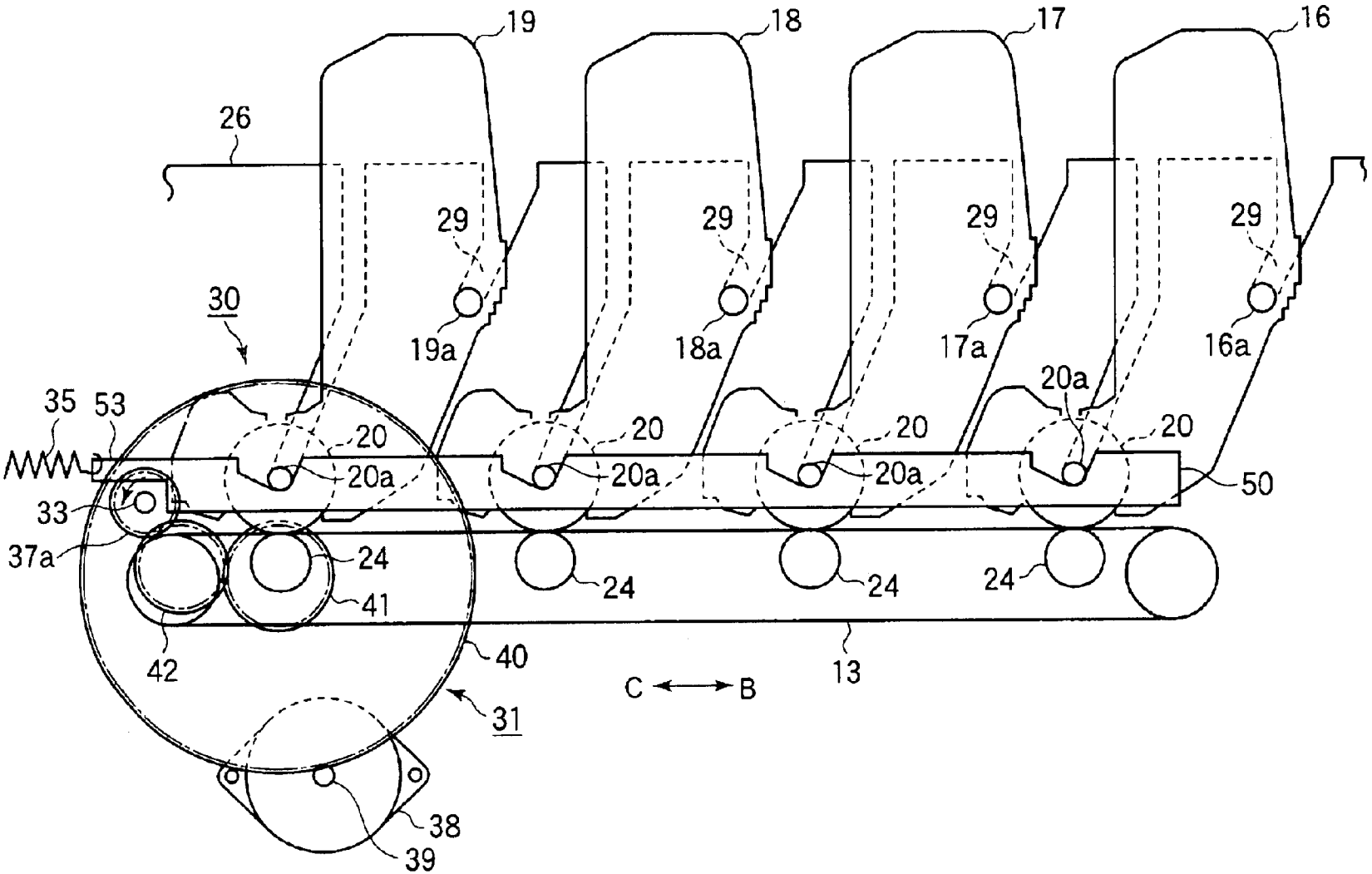
FIG. 5 illustrates a pertinent portion of a second embodiment.

FIG. 5 illustrates a pertinent portion of a second embodiment.

Figure 6:
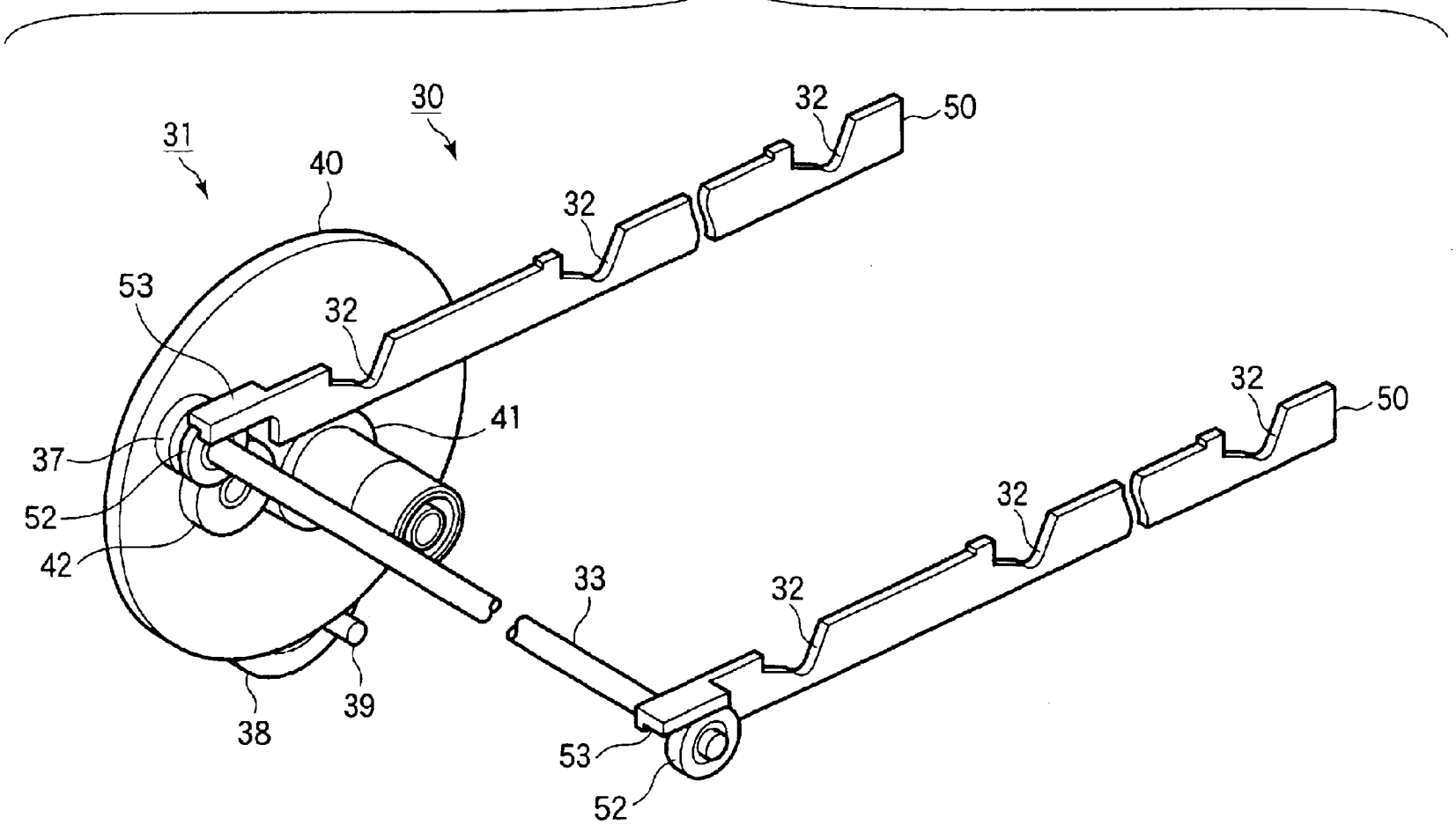
FIG. 6 is a perspective view of an up-and-down mechanism according to the second embodiment.

FIG. 6 is a perspective view of an up-and-down mechanism according to the second embodiment.

The second embodiment differs from the first embodiment in that a pinion gear 52 is fixed to the shaft 33 by means of a one way gear instead of the eccentric cam 34, and a rack 53 in mesh with the pinion gear 52 is formed in a slide link 50. When the shaft 33 rotates in a direction shown by an arrow, the one way gear 37*a* engages the shaft 33 and is driven in rotation to cause the slide links to move so that the image forming sections are moved to the up positions. When the shaft 33 rotates in the opposite direction to the direction shown by the arrow, the one way gear 37*a* disengages from the shaft 33. Thus, the one way gear 37*a* is not driven in rotation, and the image forming sections slide down to the down positions due to their own weights and the urging force of the spring 35.

The operation of the second embodiment is the same as that of the first embodiment and the description thereof is omitted.

The use of a rack-and-pinion construction allows driving the slide links with a constant torque.

Third Embodiment

{Construction}

Figure 7:
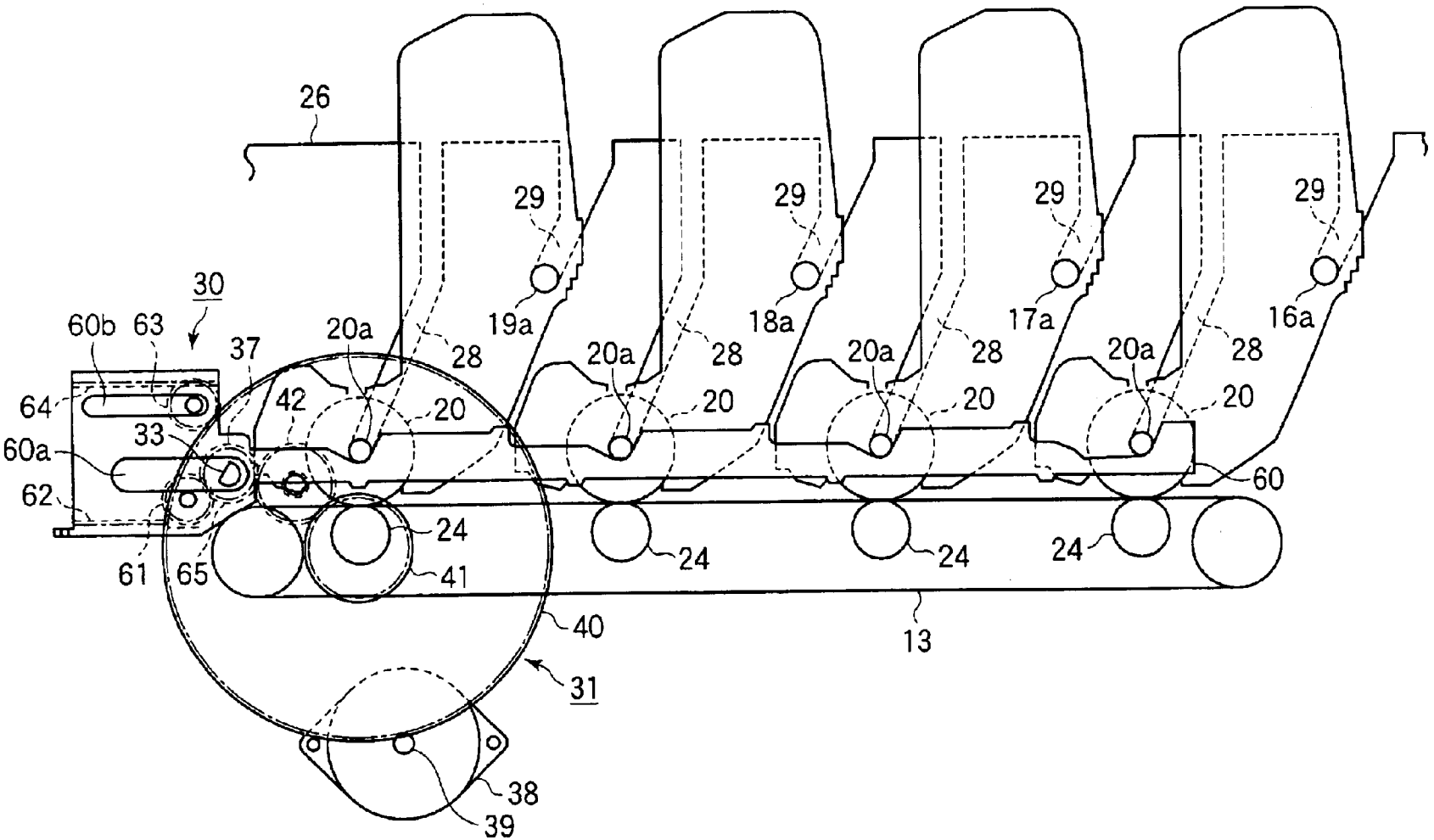
FIG. 7 illustrates a pertinent portion of a third embodiment.

FIG. 7 illustrates a pertinent portion of a third embodiment.

Figure 8:
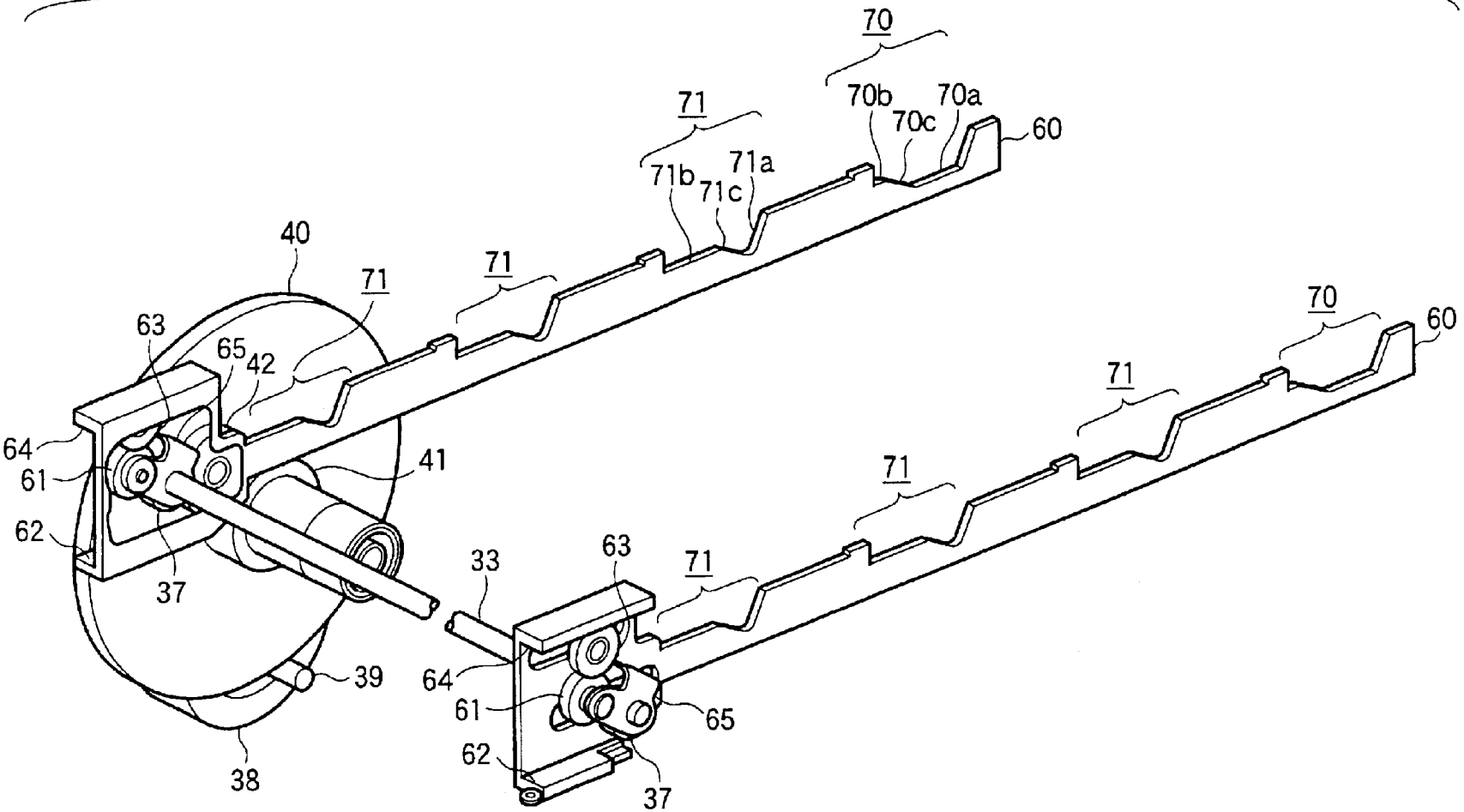
FIG. 8 is a perspective view of an up-and-down mechanism according to the third embodiment.

FIG. 8 is a perspective view of an up-and-down mechanism according to the third embodiment.

The third embodiment differs from the first embodiment in that a planetary gear 61 is in mesh with the gear 37, and a slide link 60 is formed with a first rack 62 and a second rack 64 therein at one end portion of the slide link, and a guide surface 70 have a different shape from guide surfaces 71. The first rack 62 is in mesh with the planetary gear 61 via a pinion gear 63. The guide surface 70 serves to cause the image forming section 16 to move to its up position and down position.

The gears 37 and 37, which serve as a sun gear, are fixedly attached to the shaft 33 to which brackets 65 and 65 are rotatably mounted. The planetary gears 61 and 61 are rotatably mounted to one end of the brackets 65 and 65, respectively.

The frames 26 and 27 have the pinion gears 63 and 63 that are in mesh with the planetary gears 61 and 61, respectively. The slide links 60 an 60 have elongated holes 60*a* and 60*b* that allow some movement of the shafts of the pinion gears 63 and 63 and the shaft 33 in the B and C directions.

The guide surfaces 70 on the slide link 60 and 60 each include a first guide surface 70*a*, a second guide surface 70*b*, and a beveled surface 70*c* continuous with the first and second guide surfaces 70*a* and 70*b*. The guide surface 71 includes a first guide surface 71*b*, a second guide surface 71*a*, and a beveled surface 71*c* continuous with the first and second guide surfaces 71*a* and 71*b*. The first guide surface 71*b* is longer than the second guide surface 70*b*.

{Operation}

Figure 9:
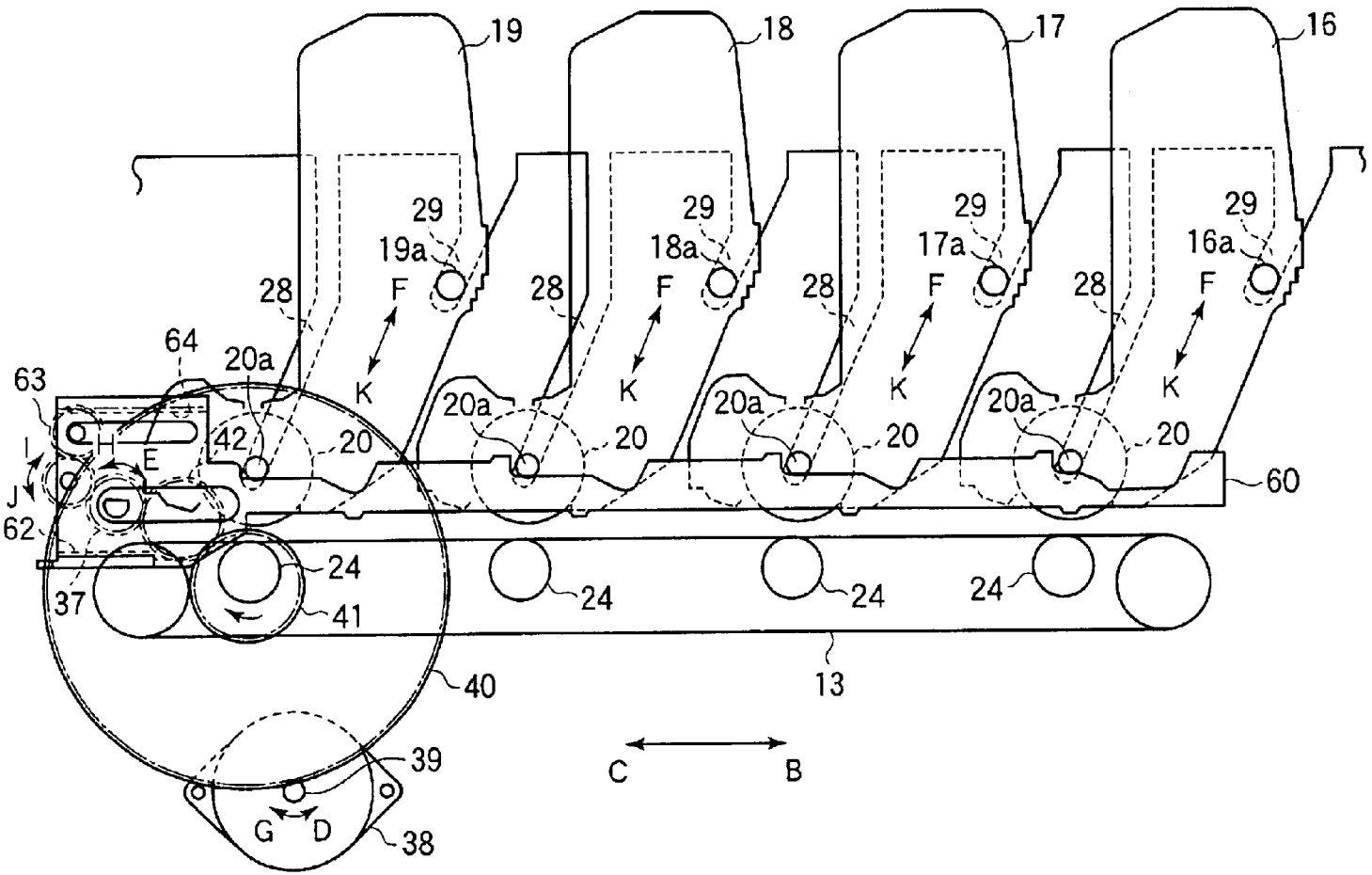
FIG. 9 illustrates the image forming sections when they are away from a transport belt.

FIG. 9 illustrates the image forming sections 16–19 when they are away form the transport belt 13.

The operation of the third embodiment will be described with reference to FIG. 9.

When printing is not to be performed, the drive motor 38 is rotated in the D direction so that the gears 40–42 rotate in the directions shown by arrows to cause the gear 37 to rotate in the E direction.

The rotation of the gear 37 in the E direction causes the shaft 33 and planetary gears 61 and 61 to rotate together with the gear 37, so that the brackets 65 and 65 rotate in a direction shown by arrow I. The rotation of the brackets 65 and 65 in the I direction causes the planetary gears 61 and 61 to move into meshing engagement with the rack 64, thereby causing the slide links 60 and 60 to move in the B direction.

The rotation of the slide links 60 and 60 causes the shafts 20*a* of the photoconductive drums 20 of the image forming sections 16–19 to move in the guide grooves 28 and along the guide surfaces 70 and 71 in the F direction. As a result, the shafts 16*a*, 17*a*, 18*a*, and 19*a*, which extend from the side walls of the image forming sections 16–19, also move in the guide grooves 29.

The drive motor 38 is stopped when the shafts 20*a* are brought on the second guide surfaces 70*b* and 71*b* of the guide surfaces 70 and 71, respectively, and thereafter a holding current is supplied to the drive motor 38. The image forming sections 16–19 are now in their up positions.

When printing is to be performed, the drive motor 38 rotates in the G direction to cause the gear 37 to rotate in the H direction. The rotation of the gear 37 in the H direction causes the shaft 33 and planetary gears 61 and 61 to rotate together with the gear 37 so that the brackets 65 and 65 rotate in a direction shown by arrow J. The rotation of the brackets 65 and 65 in the J direction causes the planetary gears 61 and 61 to move into meshing engagement with the rack 62 so that the slide links 60 and 60 move in the C direction.

When the shaft 20*a* of the photoconductive drum of the image forming section 16 rests on the first guide surface 70*a* and the shafts 20*a* of the photoconductive drums of the image forming sections 17–19 rest on the second guide surfaces 71*b*, the drive motor 38 is stopped. Then, an appropriate holding current is supplied to the drive motor 38. The image forming section 16 is now at its down position while the image forming sections 17–19 are still at their up positions.

When the image forming section 16 is at its down position, the photoconductive drum 20 of the image forming section 16 is in pressure contact with the transport belt 13 while the photoconductive drums of the image forming sections 17–19 are away from the transport belt 13. This allows printing to be performed in the monochrome printing mode.

When the slide links 60 and 60 are further moved in the C direction, the shaft 20*a* of the image forming section 16 rests on the first guide surface 70*a* and the shafts 20*a* of the image forming sections 17–19 rest on the first guide surfaces 71*a*. Then, the drive motor is stopped and then a holding current is supplied to the drive motor 38. The image forming sections 16–19 are now in their down positions.

According to the third embodiment, the photoconductive drums 20 except for that of the image forming section 16 are not in pressure contact with the transport belt 13 during the monochrome printing mode. Therefore, the friction between the photoconductive drums 20 of the image forming sections 17–19 and the transport belt 13 is eliminated. This prolongs the life of the photoconductive drums 20.

The third embodiment has been described with respect to a case in which an appropriate holding current is run to hold the drive source at a fixed rotational position. However, since the shafts 20*a* rest on the flat guide surfaces, the holding current may not necessarily be required to hold the shafts at rest. This saves electric energy.

When no printing is being performed, the photoconductive drums 20 are away from the transport belt 13, so that the additives deposited on the transport belt 13 do not contaminate the photoconductive drums 20.

{Modification}

Figure 10:
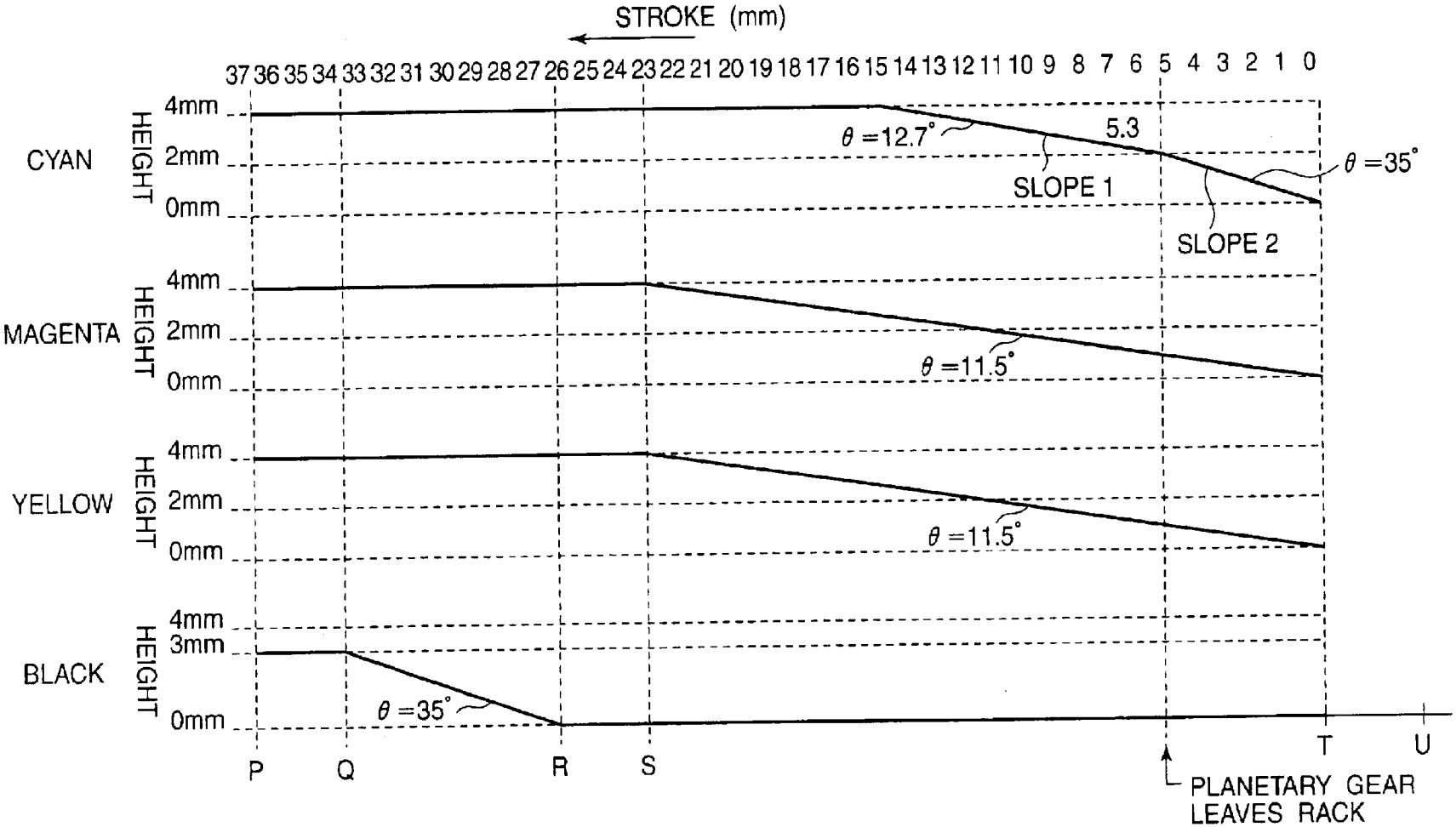
FIG. 10 illustrates the shapes and inclinations of guide surfaces formed in the slide link according to a modification to the third embodiment.

FIG. 10 illustrates the shapes and inclinations of the guide surfaces formed in the slide link according to a modification to the third embodiment.

Figure 11:
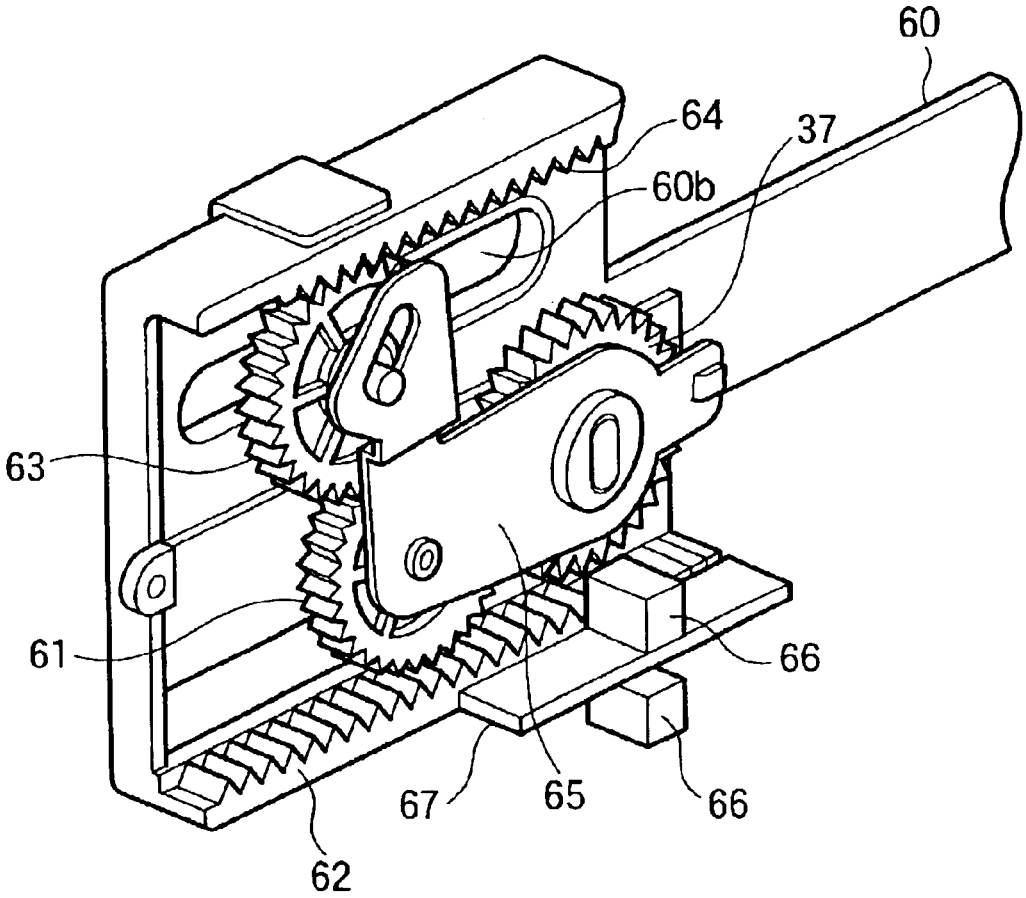
FIG. 11 is a perspective view of a pertinent portion of an up-and-down mechanism according to a modification; modification of the third embodiement.

FIG. 11 is a perspective view of a pertinent portion of an up-and-down mechanism according to modification.

Figure 12:
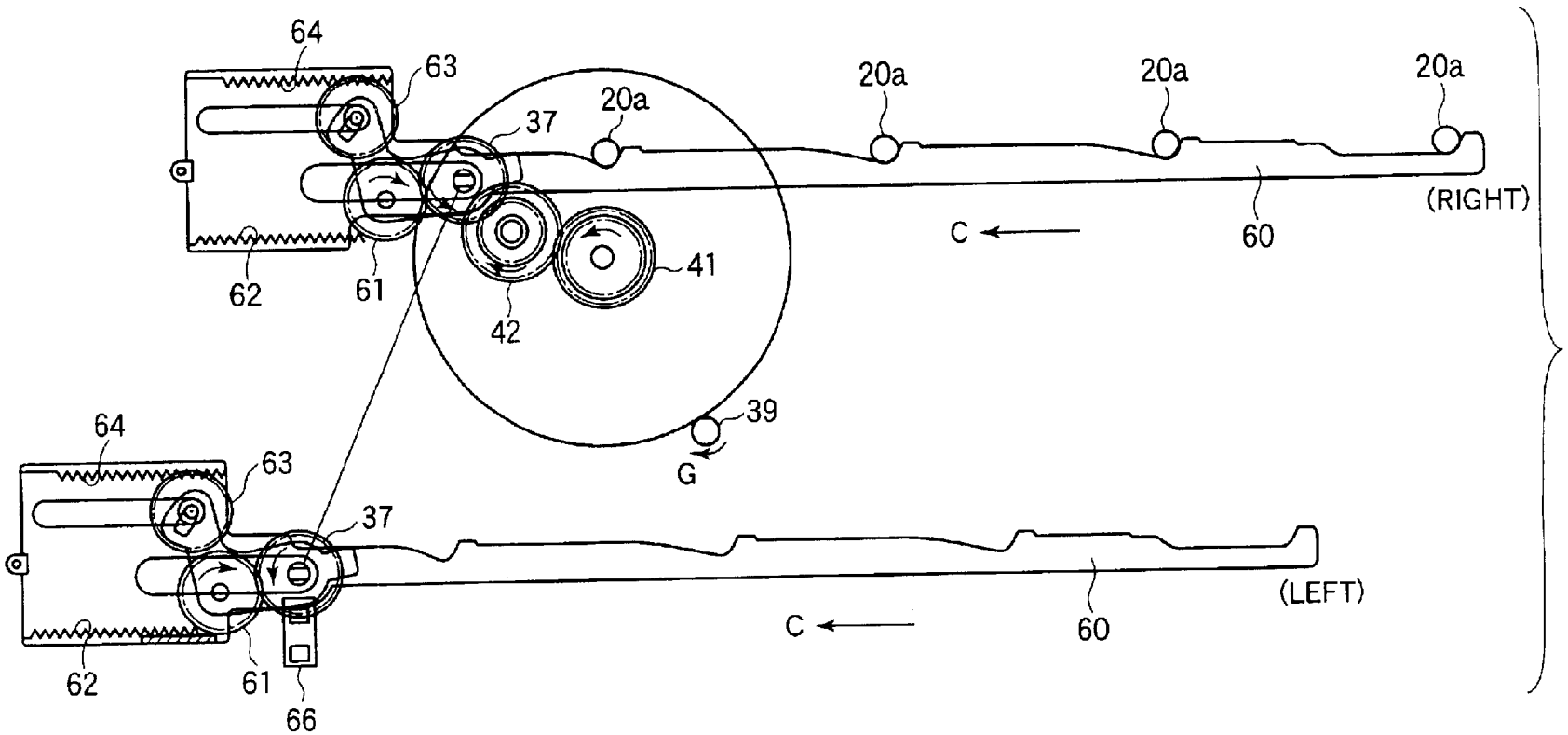
FIGS. 12 and 13 are side views of the up-and-down mechanism of FIG. 11.
Figure 13:
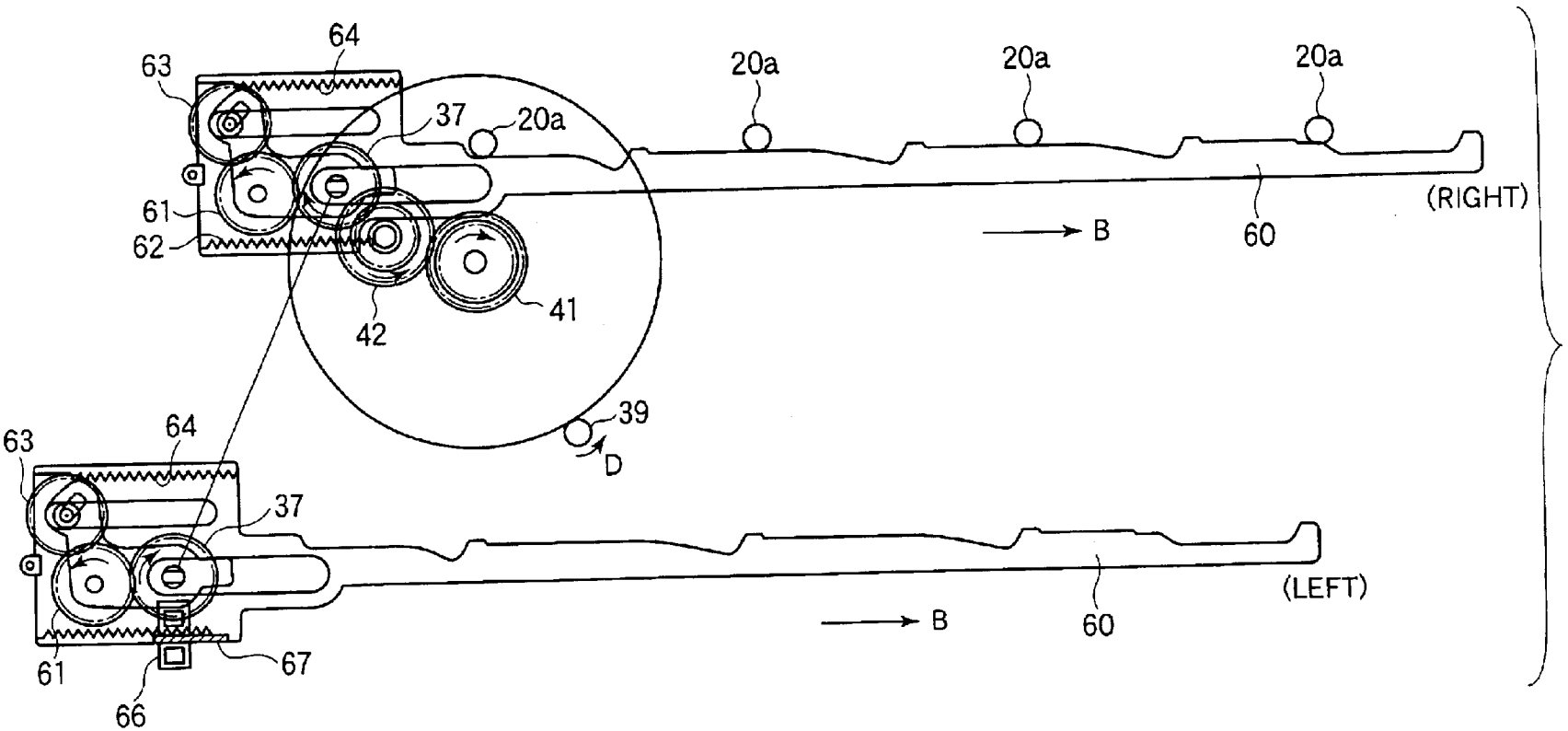

FIGS. 12 and 13 are side views of the up-and-down mechanism of FIG. 11, showing the positional relation between the slide link and a photo sensor 66.

The guide surfaces for image forming sections 17 and 18 (magenta and yellow) have the same inclination of, for example, $\theta=11.5°$. The guide surface for the image forming section 16 (black) has an inclination of, for example, $\theta=35°$. The guide surface for the image forming section 19 (cyan) has two inclinations of, for example, $\theta=12.7°$ and $\theta=35°$. The combination of the aforementioned different inclinations of the guide surfaces are selected in order to reduce noises when the image forming sections 16–19 are moved to their down positions.

When the planetary gear 61 rotates in mesh with the rack 62 formed in the bracket 65 to drive the slide link 60 to move in the C direction, the shaft 20*a* of the cyan image forming section 19 slides down on a first slope 1. When the shaft 20*a* moves from the slope 1 to the slope 2, the planetary gear 61 disengages from the rack 62 and the shaft 20*a* slides down on the slope 2 by its self with the aid of the weight of the image forming section 19 and the tensile urging force of the urging member 35 bringing the image forming section 19 into its down position. When the drive motor 38 for the image forming section 19 rotates during a printing operation in the color printing mode, the planetary gear 61 also rotates but the rotation of the planetary gear 61 is not transmitted to the rack 62 because the planetary gear 61 has disengaged from the rack 62.

The racks 64 formed in the left and right brackets 65 and 65 are of the same length. The racks 62 are shorter than the racks 64. The rack 62 formed in the left bracket 65 differs from the rack 62 formed in the right bracket 65 in length, so that when the image forming section 19 is at its down position, the planetary gear 61 is sufficiently away from the rack 62 in the left bracket to prevent inadvertent engagement of the planetary gear 61 with the rack 62.

A photo sensor 66 is provided to detect the movement of the left slide link 25. The drive force transmitting section 31 is disposed on the side of the right slide link. When the slide links 25 and 25 are driven by the drive force transmitting section 31, the overall structural members are twisted somewhat. The twisting causes a delay in the movement of the left slide link 25. Thus, the sensor 66 is provided on the side of the left slide link 25 and the control is performed in response to the detection output of the sensor 66, thereby ensuring reliable positioning of the slide links 25 and 25. The left slide link 25 has a blocking plate 67 that interrupts and opens the optical path of the photo sensor 66 when the left slide link moves in the B and C directions.

When the slide link moves in the B direction, the blocking plate 67 interrupts the photo sensor 66. The slide link is further moved a predetermined distance in the B direction after the blocking plate 67 interrupts the optical path of the sensor, thereby bringing the image forming sections 17–19 to their up positions. When the slide link moves a predetermined distance still further in the B direction, the image forming section 16 is brought to its up position.

Conversely, when the slide links 25 are moved a predetermined distance in the C direction, the image forming section 16 is first brought to its down position. When the slide links are moved still further a predetermined distance in the C direction after the blocking plate 67 leaves the photo sensor 66, the image forming sections 17–19 are brought to their down positions. After the image forming sections are brought to their down positions, the drive motor 38 is rotated reverse by a small amount. This is to set the respective gears at such rotational positions that the tooth of one of the gears in mesh are substantially at the center between adjacent teeth of the other.

Fourth Embodiment

Figure 14:
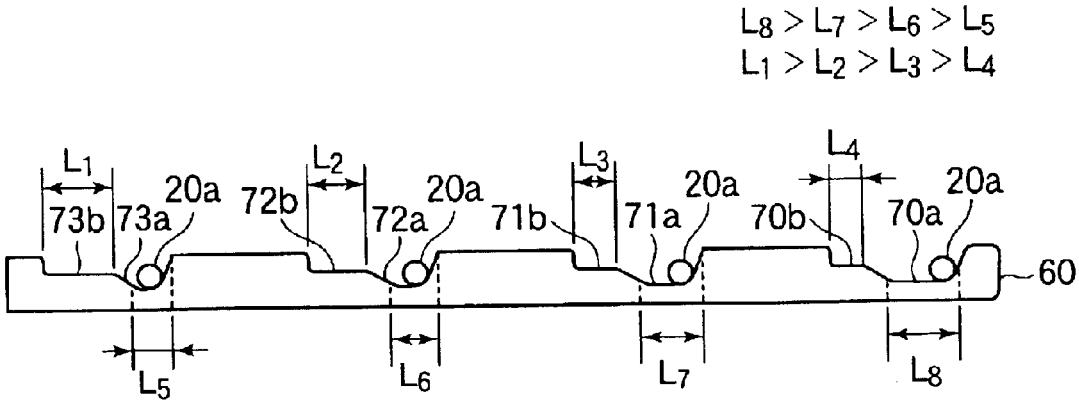
FIG. 14 illustrates the detail of a slide link according to a fourth embodiment.

FIG. 14 illustrates the detail of a slide link according to a fourth embodiment.

FIGS. 15A–15E illustrate the operation of the fourth embodiment.

The fourth embodiment differs from the third embodiment in that guide surfaces formed in the slide links 60 an 60 are all of different shapes.

Referring to FIG. 14, a slide link according to the fourth embodiment has guide surfaces 70, 71, 72, 73. The guide surfaces for the image forming sections 16–19 include first guide surfaces 70*a*, 71*a*, 72*a*, and 73*a*, second guide surfaces 70*b*, 71*b*, 72*b*, and 73*b*, and beveled surfaces 70*c*, 71*c*, 72*c*, and 73*c*. The first guide surfaces 70*a*, 71*a*, 72*a*, and 73*a*are progressively long in this order, i.e., L1>L2>L3>L4. The second guide surfaces 70*b*, 71*b*, 72*b*, and 73*b* are progressively short in this order, i.e., L8>L7>L6>L5.

Figure 15A:
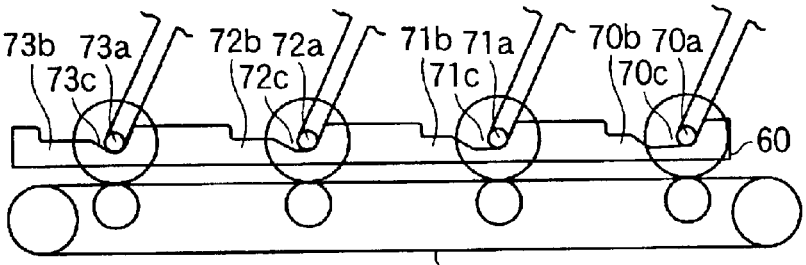
FIGS. 15A–15E illustrate the operation of the fourth embodiment.

Referring to FIG. 15A, the slide links 60 and 60 are moved completely leftward in the color printing mode, so that the shafts 20*a* of the photoconductive drums 20 of the image forming sections 16–19 rest on the second guide surfaces 70*a*, 71*a*, 72*a*, and 73*a*. Then, the drive motor 38 is stopped when the photoconductive drums 20 are in pressure contact with the transport belt 13. Thereafter, a holding current is supplied to the drive motor 38.

Figure 15B:
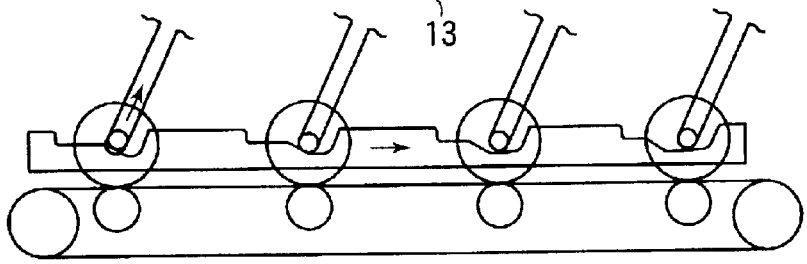
Figure 15C:
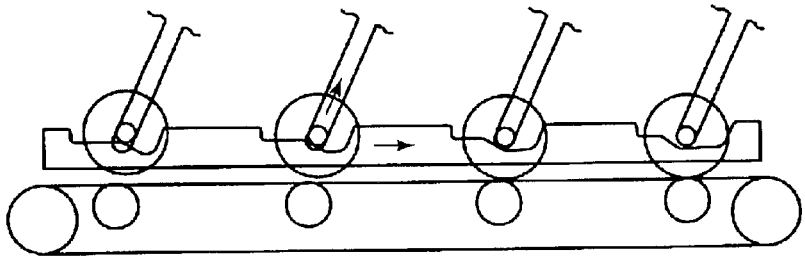
Figure 15D:
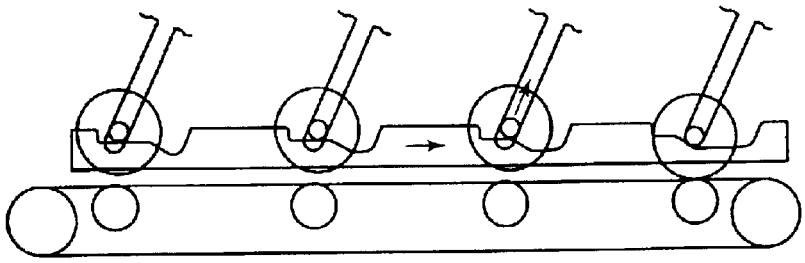
Figure 15E:
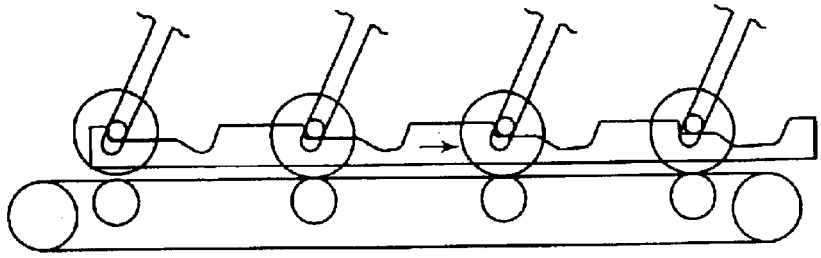

In order to enter the monochrome printing mode, the slide links 60 and 60 are moved rightward in the direction of arrow to the positions as shown in FIG. 15B, FIG. 15C, FIG. 15D, and finally as shown in FIG. 15E. In this manner, the shafts 20*a* of the photoconductive drums 20 of the image forming sections 17–19 move from their down positions to their up positions sequentially. The shafts 20*a* move from the first guide surfaces 71*a*, 72*a*, and 73*a* to the second guide surfaces 71*b*, 72*b*, and 73*b* through the beveled surfaces 71*c*, 72*c*, and 73*c*, respectively. In other words, the shafts 20*a* move in such a way that when one of the shafts climbs on its corresponding beveled surface, the other shafts are either on their first guide surface or on their second guide surface. Thus, the photoconductive drums 20 of the image forming sections 17–19 are moved away from the transport belt 13, and only the photoconductive drum 20 of the image forming section 16 is in pressure contact with the transport belt 13. Then, the drive motor 38 is stopped and an appropriate holding current is supplied to the drive motor 38.

As described above, only one of the three shafts climbs on beveled surface at any moment when the slide links 60 and 60 are moved from FIG. 15A position to FIG. 15E position, thereby reducing a minimum torque required of the drive motor 38 as well as saving electric energy.

As soon as one of the image forming sections 17–19 has climbed up a corresponding beveled surface, the next one begins to climb a corresponding beveled surface, thereby minimizing the overall time required for all of the image forming sections to climb up the corresponding beveled surfaces.

Small minimum torque makes the motor size and cost smaller, eliminating the need for using the motor of the image forming section. This eliminates or simplifies the structure that transmits the drive force from the motor of the image forming section.

Fifth Embodiment

{Construction}

Figure 16:
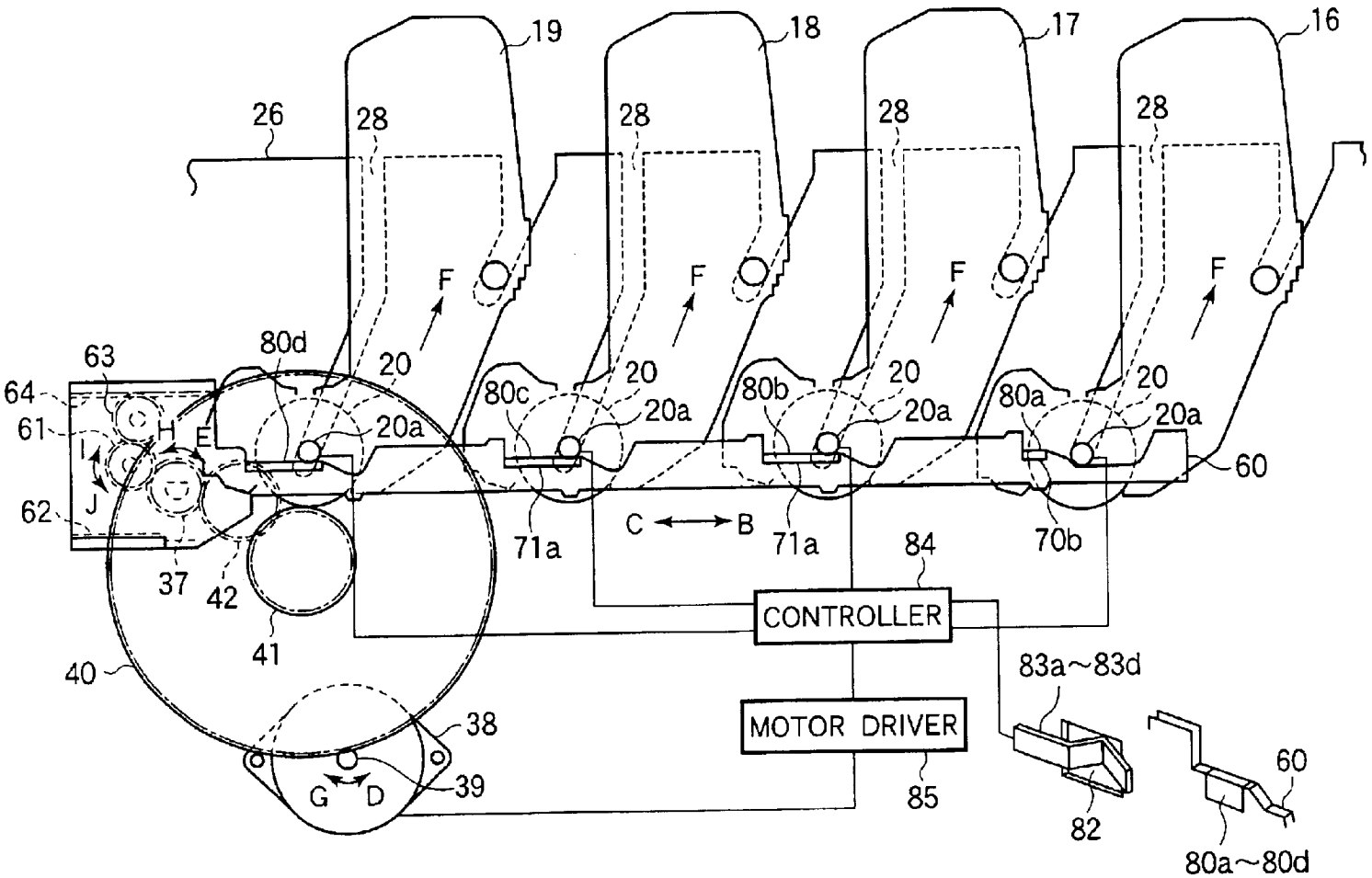
FIG. 16 illustrates the details of a pertinent portion of a fifth embodiment.

FIG. 16 illustrates the details of a pertinent portion of a fifth embodiment.

The fifth embodiment differs from the third embodiment in that a slide-detector is incorporated for detecting an amount of movement of slide links.

The slide-detector includes first electrodes 80*a*, 80*b*, 80*c*, and 80*d* provided on the second guide surfaces 70*b* and 71*a*, second electrodes 83*a*, 83*b*, 83*c*, and 83*d* that extend through windows 82 formed in the side walls between which the slide links are disposed, a controller 84, and a motor driver 85 for driving the drive motor 38. The controller 84 is connected to the second electrodes 83*a*, 83*b*, 83*c*, and 83*d*, motor driver 85, and shafts 20*a*. For example, when the second electrode 83*a* moves into contact engagement with the first electrode 80*a*, a closed electrical circuit is made up by the controller 84, shaft 20*a*, first electrode 80*a*, second electrode 83*a*, and the controller 84.

{Operation}

The operation of the fifth embodiment will be described with reference to FIG. 16. The controller 84 controls the drive motor 38 by using pulses. The drive motor 38 is stopped by a combination of signals that indicate electrical contacts between the first electrodes 80*a*, 80*b*, 80*c*, and 80*d* and the second electrodes 83*a*, 83*b*, 83*c*, and 83*d*.

When printing is not being performed, the controller 84 controls the motor driver 85 to drive the drive motor 38 to rotate in the D direction. The gears 40–42 rotate in directions shown by arrows to cause the gear 37 to rotate in the E direction.

The rotation of the gear 37 in the E direction causes the shaft 33 and planetary gears 61 and 61 to rotate together. The rotation of the shaft 33 and planetary gears 61 and 61 causes the brackets 65 and 65 to rotate in the I direction so that the planetary gears 61 and 61 move into meshing engagement with the rack 64. This operation causes the slide links 60 and 60 to move in the B direction.

The movement of the slide links 60 and 60 causes the shafts 20*a* of the photoconductive drums 20 of the image forming sections 16–19 on the guide surfaces 70 and 71 (FIG. 8) to move along the guide grooves 28 in the F direction. The shafts 16*a*, 17*a*, 18*a*, and 19*a*, which project from the side walls of the image forming sections 16–19, also move along the guide grooves 29 in the F direction.

The drive motor 38 is stopped when the shafts 20*a* has moved to positions where shafts 20*a* rest on the first guide surfaces 70*b* and 71*a* of the guide surfaces 70 and 71, respectively, and the detector has detected that the first electrodes 80*a*, 80*b*, 80*c*, and 80*d* have moved into contact with the second electrodes 83*a*, 83*b*, 83*c*, and 83*d*.

When printing is to be performed in the monochrome printing mode, the controller 84 controls the motor driver 85 to drive the drive motor 38 to rotate in the G direction. The gears 40–42 rotate in the directions shown by the arrows, causing the gear 37 to rotate in the H direction.

The rotation of the gear 37 in the H direction causes the shaft 33, planetary gears 61 and 61 to rotate together, so that the brackets 65 and 65 rotates in the J direction to move the planetary gears 61 and 61 into meshing engagement with the rack 62. This operation causes the slide links 60 and 60 to move in the C direction.

When the first electrode 80*a* is detected not to be in contact with the second electrode 83*a* and the first electrodes 80*b*, 80*c*, and 80*d* are detected to be in contact with the second electrodes 83*b*, 83*c*, and 83*d*, the drive motor 38 is stopped.

When printing is to be performed in the color printing mode, the controller 84 controls the motor driver 85 to drive the drive motor 38 in rotation in the G direction, thereby causing the slide links 60 and 60 to move in the C direction.

When the first electrodes 80*b*, 80*c*, and 80*d* are detected to be in contact with the second electrodes 83*b*, 83*c*, and 83*d*, and the first electrode 80*a* is detected to be in contact with the second electrode 83*a*, the drive motor 38 is stopped.

According to the fifth embodiment, the slide links can be controllably moved while detecting that the accurate positions of the image forming sections are a predetermined distance away from the transport belt 13.

Sixth Embodiment

Figure 17:
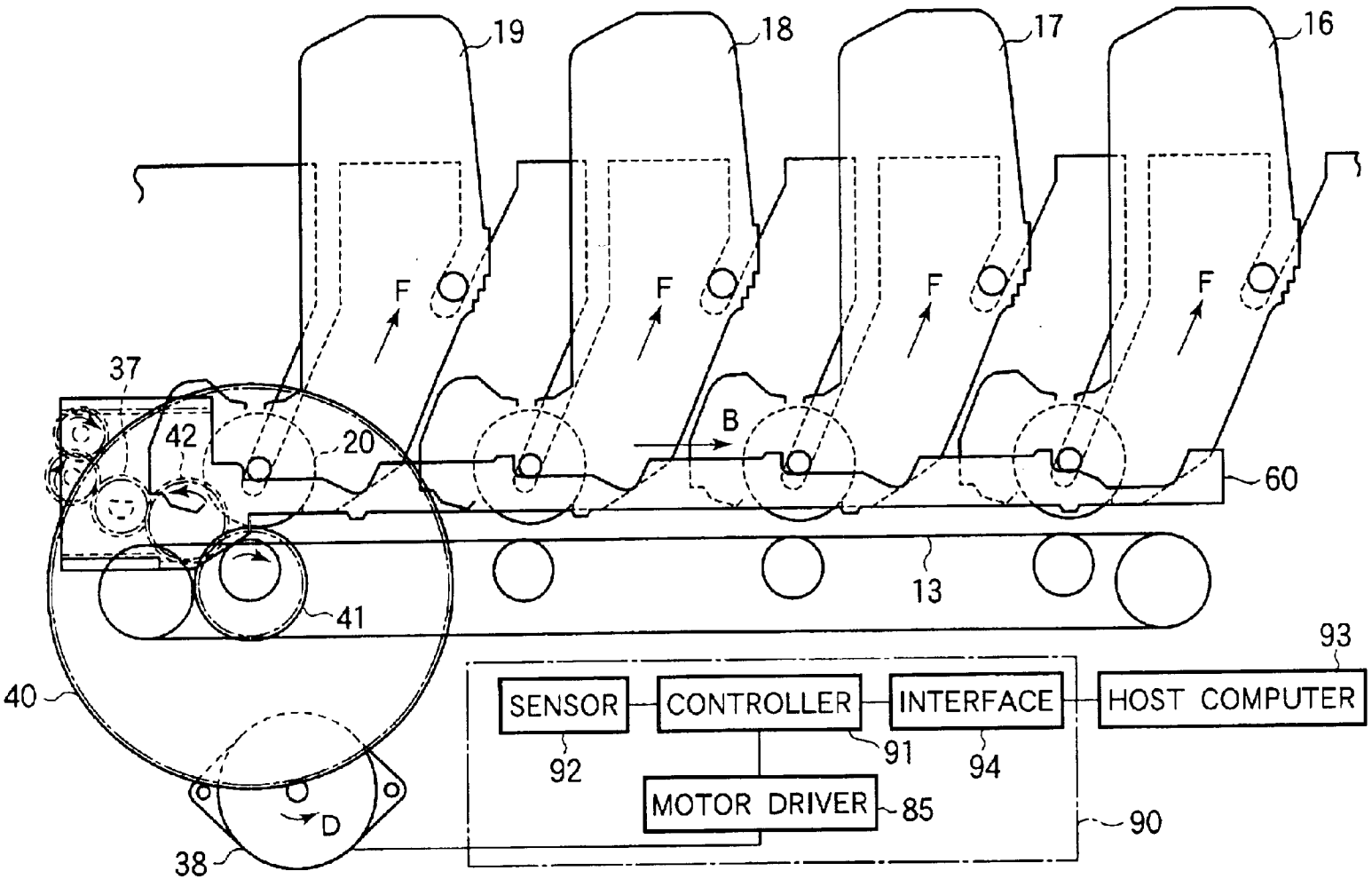
FIG. 17 illustrates the details of a pertinent portion of a sixth embodiment.

FIG. 17 illustrates the details of a pertinent portion of a sixth embodiment. The sixth embodiment differs from the third embodiment in that an abnormal distance detector 90 is provided.

The abnormal distance detector 90 includes a controller 91, a sensor 92 that includes paper sensors provided on the medium path 10 in FIG. 1, an interface 94 that connects a host computer 93 and the controller 91, and the motor driver 85 for driving the drive motor 38.

The operation of the sixth embodiment will be described. When the paper becomes jammed in the medium path 10 in FIG. 1, the sensor 92 sends a detection signal to the controller 91. Upon receiving the detection signal, the controller 91 sends a signal to the motor driver 85 which in turn causes the drive motor 38 to rotate in the D direction so that the slide links 60 and 60 move in the B direction. The movement of the slide links 60 and 60 in the B direction causes the image forming sections 16–19 to be raised in the F directions so that the image forming sections 16–19 are away from the transport belt 13.

If a print job is not inputted more than a predetermined length of time from a host computer 93, the controller 91 causes the image forming sections 16–19 to move away from the transport belt 13.

According to the sixth embodiment, the image forming sections 16–19 can be moved away from the transport belt 13 promptly when the apparatus enters a standby condition and when trouble such as paper jam happens in paper transport. This prevents contamination of the components in contact with one another and deterioration of print quality.

In the aforementioned first to sixth embodiments, the shafts of the photoconductive drums are moved up and down along the guide surfaces so that the image forming sections are moved up and down relative to the transport belt. The slide link may be configured in such a way that as the slide links are moved, the shafts of the photoconductive drums are inclined to be away from the transport belt surface.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A color image recording apparatus in which a plurality of image forming sections form images and the images are transferred onto a recording medium to form a color image, the apparatus comprising:

a mechanism that causes the plurality of image forming sections to be positioned either at corresponding image forming positions or at corresponding non-image forming positions; and a plurality of drive sources that drive corresponding ones of the plurality of image forming sections when recording is performed, wherein one of the plurality of drive sources is also a first drive source that drives said mechanism to position an image forming section corresponding to the first drive source and at least another one of the plurality of image forming sections either at the corresponding image forming positions or at the corresponding non-image forming positions.

2. The color image recording apparatus according to claim 1, wherein when each of the plurality of image forming sections is at a corresponding one of the image forming positions, the each of the plurality of image forming sections is in contact with a transport belt that runs with the recording medium placed thereon;

wherein when each of the plurality of image forming sections is at a corresponding one of the non-image forming positions, the each of the plurality of image forming sections is not in contact with the transport belt.

3. The color image recording apparatus according to claim 1, wherein the plurality of image forming sections are aligned along a transport direction in which a transport belt runs through the plurality of image forming sections, wherein said first drive source is an electric motor that drives one of the plurality of image forming sections that is located most downstream with respect to the transport direction.

4. The color image recording apparatus according to claim 1, wherein said mechanism causes one of the plurality of image forming sections and another one of the plurality of image forming sections to switch in different ways from one another between corresponding image forming positions and corresponding non-image forming positions.

5. The color image recording apparatus according to claim 4, wherein the plurality of image forming sections include color image forming sections and a monochrome image forming section;

wherein when the plurality of image forming sections should be moved to the corresponding image forming positions, said mechanism causes the monochrome image forming section to move to a corresponding image forming position and subsequently the color image forming sections to move to corresponding image forming positions; and wherein when the plurality of image forming sections should be moved to the corresponding non-image forming positions, said mechanism causes the color image forming sections to move to corresponding non-image forming positions and subsequently the monochrome image forming section to move to a corresponding non-image forming position.

6. A color image recording apparatus in which a plurality of image forming sections form images and the images are transferred onto a recording medium to form a color image, the apparatus comprising:

a mechanism that causes the plurality of image forming sections to switch between corresponding image forming positions and corresponding non-image forming positions; and a first drive source that generates a drive force that drives said mechanism, said drive source being one of second drive sources that drive the plurality of image forming sections when recording is performed;

wherein said mechanism includes:

a pair of slide links that extend and are slidable in first directions substantially perpendicular to directions in which the plurality of image forming sections move between the corresponding image forming positions and the corresponding non-image forming positions;

wherein each slide link of the pair of slide links has a first guide surface on which a supporting shaft of a corresponding one of image forming sections rests when the corresponding one of image forming sections is at a corresponding one of the image forming positions, and a second guide surface on which the supporting shaft of the corresponding one of image forming sections rests when the corresponding one of image forming sections is at a corresponding one of the non-image forming positions.

7. The color image recording apparatus according to claim 6, further comprising a drive force transmitting section that transmits the drive force from the first drive source to said pair of slide links;

wherein the drive force transmitting section includes:

a rotating shaft which extends in a direction at an angle with the first directions and to which a one way gear is mounted;

racks provided on corresponding one ends of the slide links;

gears mounted to said rotating shaft through the one way gear, each of said gears being in meshing engagement with each of said racks and rotating together with said rotating shaft when the supporting shaft of each of image forming sections moves from the first guide surface to the second guide surface; and a gear train through which the drive force is transmitted to said gears.

8. The color image recording apparatus according to claim 6, further comprising a drive force transmitting section that transmits the drive force from the first drive source to said pair of slide links;

wherein the drive force transmitting section includes:

a rotating shaft which extends in a direction at an angle with the first directions and to which eccentric cams each of which has a cam surface are mounted;

urging members each of which urges one longitudinal end of a corresponding one of the slide links against the cam surface;

a gear mounted to said rotating shaft through a one way clutch that engages to rotate together with said rotating shaft when the supporting shaft of the corresponding one of image forming sections moves from the first guide surface to the second guide surface; and a gear train through which the drive force is transmitted to the gear.

9. The color image recording apparatus according to claim 6, wherein each slide link of the pair of slide links has a beveled surface through which the first guide surface is connected to the second guide surface.

10. The color image recording apparatus according to claim 6, further comprising a slide detector that detects an amount of movement of said pair of slide links in the first directions, wherein said first drive source is controlled in accordance with the amount of movement.

11. The color image recording apparatus according to claim 6, further comprising a drive force transmitting section that transmits the drive force from the first drive source to said pair of slide links;

wherein the drive force transmitting section includes:

a rotating shaft which extends in a direction at an angle with the first directions;

a sun gear mounted to said rotating shaft;

a first rack and a second rack provided on one end of each slide link of said pair of slide links;

a pinion gear in mesh with the second rack;

a gear train through which the drive force is transmitted to the sun gear;

a planetary gear that rotates in mesh with the sun gear, wherein when the image forming sections should be moved to the corresponding image forming positions, the planetary gear moves into meshing engagement with the first rack, wherein when the image forming sections should be moved to the corresponding non-image forming positions, the planetary gear moves around the sun gear into meshing engagement with the pinion gear.

12. A color image recording apparatus in which a plurality of image forming sections form images and the images are transferred onto a recording medium to form a color image, the apparatus comprising:

a mechanism that causes the plurality of image forming sections to switch between corresponding image forming positions and corresponding non-image forming positions;

a first drive source that generates a drive force that drives said mechanism, said drive source being one of second drive sources that drive the plurality of image forming sections when recording is performed; and a jam detector;

wherein when the jam detector detects a jam of the recording medium, said first drive source drives the image forming sections to move to the corresponding non-image forming positions.

13. A color image recording apparatus in which a plurality of image forming sections form images and the images are transferred onto a recording medium to form a color image, the apparatus comprising:

a belt;

a first image forming section and at least one second image forming section, said first image forming section and said at least one second image forming section forming corresponding images;

a mechanism that brings said belt, said first image forming section, and said at least one second image forming section either into an image-forming condition in which said first image forming section and said at least one second image forming section are in contact with said belt, or into a non-image forming condition in which said first image forming section and said at least one second image forming section are not in contact with said belt; and a first drive source that drives said first image forming section to form a corresponding image, and at least one second drive source that drives said at least one second image forming section to form a corresponding image;

wherein said first drive source drives said mechanism to bring said belt, said first image forming section, and said at least one second image forming section into the non-image forming condition.

* * * * *